US005088587A

United States Patent [19]

Goodrich et al.

[11] Patent Number: 5,088,587

[45] Date of Patent: Feb. 18, 1992

[54] CLEAR-OUT APPARATUS FOR A COIN CHUTE

[75] Inventors: Robert R. Goodrich; James D. York, both of Indianapolis, Ind.

[73] Assignee: AT&T Bell Laboratories, Murray Hill, N.J.

[21] Appl. No.: 516,932

[22] Filed: Apr. 30, 1990

[51] Int. Cl.[5] ..... G07F 1/04

[52] U.S. Cl. ..... 194/345; 194/347; 194/351

[58] Field of Search ..... 194/202, 321, 335, 344, 194/345-349, 351

[56] References Cited

U.S. PATENT DOCUMENTS

| | | | |
|---|---|---|---|
| 638,967 | 12/1899 | Jaeger et al. | 194/322 |
| 2,829,753 | 4/1958 | Fremon | 194/345 X |
| 2,897,271 | 7/1955 | Horn et al. | 179/6.3 |
| 3,559,790 | 2/1971 | Greenwald et al. | 194/335 X |
| 4,106,608 | 8/1978 | Dietz | 194/345 |
| 4,660,706 | 4/1987 | Wollet | 194/351 |
| 4,809,319 | 2/1989 | McGough | 379/153 |
| 4,815,123 | 3/1989 | McGough | 379/153 |
| 4,842,120 | 6/1989 | Dobbins et al. | 194/202 X |

*Primary Examiner*—F. J. Bartuska
*Attorney, Agent, or Firm*—Michael A. Morra

[57] ABSTRACT

A coin chute includes a coin entrance, clear-out apparatus, coin processing apparatus, a return chute and a coin ejector. The clear-out apparatus is positioned between the coin entrance and the coin processing apparatus. It comprises a cavity for trapping unwanted material stuffed into the coin entrance and a pair of sidewalls (inner and outer) that move in response to the operation of the coin ejector. A deflector plate, positioned within the cavity, assists in trapping the unwanted material. The outer sidewall permits trapped material to fall into the return chute while the inner sidewall pushes this material into the return chute. The coin ejector includes an actuator that is operatively connected to the sidewalls of the clear-out apparatus by a helical spring whose restorative force is sufficient to urge material trapped within the cavity into the return chute, but not sufficient to damage the coin ejector when excessive force is applied to the actuator.

10 Claims, 5 Drawing Sheets

CLEAR-OUT APPARATUS FOR A COIN CHUTE

TECHNICAL FIELD

This invention relates generally to coin-operated equipment and more particularly to apparatus for releasing coins and other material trapped in the coin path.

BACKGROUND OF THE INVENTION

Recently, the pay phone celebrated its one-hundredth birthday. It was invented by William Gray, and was first installed in a Hartford, Conn. bank in 1889. Although pay telephone stations preceded the invention of the pay phone, there was a big difference between the two; pay telephone stations relied on an attendant being present to collect money after a patron made a call—some attendants went so far as to lock the patron in the booths so he couldn't leave without paying. Today, with an estimated 1.8 million pay phones in service nationwide, long-distance calling from pay phones has grown to be a $2 billion-a-year industry. Indeed, in 1989, Americans made more than 850 million long-distance calls from pay phones—many of them fraudulently.

Coin telephone stations are the frequent target of vandalism and theft—possibly due to a lack of funds or the larcenous belief that it is acceptable to take something without giving something of comparable value in return. Although pay phones have been engineered to provide reliable service during environmental extremes, there is still a need to improve their resilience to the ever-evolving destructive efforts of their "patrons." Periodically, new techniques emerge for obtaining free telephone calls such as attaching a thread to the coin for later retrieval; but when they fail, frustration is vented by reverting to known and reliable acts of mischief. One recurrent activity is stuffing the coin entrance with various materials; either to preclude less destructive patrons from using the pay phone or to punish the phone for failing to recognize sticks, matchbook covers and the like as legitimate currency.

Coin telephone stations usually come equipped with a coin ejector which includes an actuator (return lever) plus appropriate linkage and other cooperating parts that enlarge the coin path in order to release trapped material into a return chute. Frequently, trapped material does not fall into the return chute so additional force is applied to the actuator which frequently results in damage to its linkage—thus adding insult to injury. It is therefore desirable to assure that trapped coins and other material will fall into the return chute when the actuator is operated, and to assure that the linkage will not be damaged when excessive force is applied.

It was only a short time after the first pay phone was put into service that the need arose for a coin ejector to prevent clogging of coin chutes from paper or like substances. Apparently coin chutes evoke a fundamental human need to subdue nature (and machines) through acts of cunning and trickery. In an attempt to foil such behavior U.S. Pat. No. 638,967 was issued to O. & A. Jaeger on Dec. 12, 1899 which discloses an ejector having movable sidewalls along a coin guideway. One sidewall moves to push out material trapped in the guideway in response to the operation of a coin ejector. Unfortunately this ejector has limited functionality and does nothing to discourage stuffing of the coin chute, or to prevent damage when the coin ejector is forcefully operated.

SUMMARY OF THE INVENTION

A coin chute includes clear-out apparatus, a coin ejector, and a return chute. The clear-out apparatus comprises a cavity for trapping material that is inserted into a coin entrance at one end of the cavity and a coin exit plus a deflector plate at its other end. Movable sidewalls are positioned on either side of the cavity that respond to the operation of the coin ejector to push-out material, trapped within the cavity, into the return chute.

In an illustrative embodiment of the invention, the coin exit from the clear-out apparatus forms the entrance to a coin processing apparatus. The coin exit is dimensioned to preclude unacceptably large coins from entering the coin processing apparatus. The coin ejector includes an actuator that is linked to the sidewalls of the clear-out apparatus by a helical spring that stores energy through elongation when sufficient force is applied by the actuator. Material trapped within the cavity will generally be dislodged before the helical spring begins to elongate. The spring therefore functions to protect the coin ejector from damage due to excessive force.

In the illustrative embodiment, the deflector plate creates an offset in the coin path that slows the velocity of each coin and dampens its dynamics so that all coins enter the coin processing apparatus at a nearly-constant velocity. Additionally, the deflector plate protects the dimensions of the coin exit by resisting the insertion of sharp objects.

BRIEF DESCRIPTION OF THE DRAWING

The features and advantages of the present invention will be more fully understood when reference is made to the detailed description together with the following drawing.

DETAILED DESCRIPTION

Figure 1:
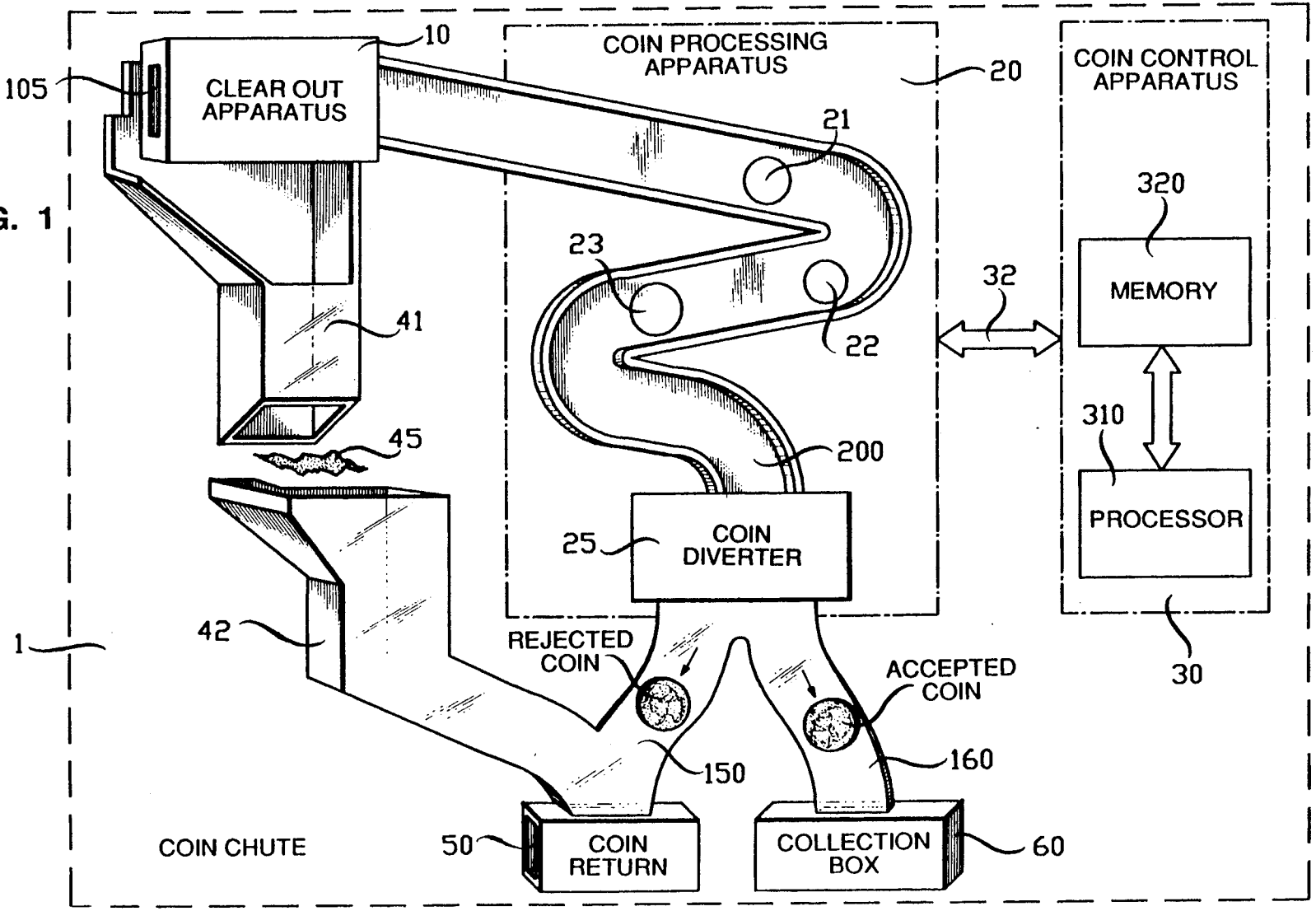
FIG. 1 sets forth the main functional components of a coin chute including a clear-out apparatus for ejecting material not suitable for further processing.

Coin chute 1, shown in FIG. 1, includes clear-out apparatus 10, coin processing apparatus 20 and coin control apparatus 30; the latter including processor 310 which controls virtually all operations of the coin chute in accordance with a program stored in memory 320 which may either be part of processor 310 or a separate device. Electrical signals are transferred between the coin control apparatus 30 and the coin processing apparatus 20 via cable 32 and includes signals indicative of a coin's properties, and signals which cause coin diverter 25 to divert acceptable coins to a collection box 60 or route unacceptable coins to a coin return 50.

In connection with FIG. 1, coin presence sensor 21 determines that a coin has been inserted into the coin processing apparatus 20 while coin quality sensors 22 and 23 are used for identifying the type of coin gravitating through coin track 200. Coins of various denominations are inserted into coin entrance 105 which is sized to admit only those coins having a predetermined maximum diameter and/or thickness. Coin entrance 105, however, is exposed to tampering and its dimensions can be enlarged to admit unacceptably large coins. Coin processing apparatus 20 is used to test coins for authenticity and denomination. Such apparatus includes an opening whose dimensions preclude unacceptably large coins from entering. Unacceptable coins having properties similar to acceptable ones in all ways other than size may not be rejected unless the dimensions of this opening are carefully chosen and maintained. The dimensions of this opening are a critical part of the overall coin acceptance criteria and should be protected against attempts to enlarge it.

Debris such as chewing gum, matchbook covers, sticks, etc., are occasionally pushed into coin entrance 105 rendering coin chute 1 unusable until such debris are removed. To this end, the coin chute includes a return chute illustratively comprising upper chute 41 and lower chute 42 as will be described. Material 45 lodged within clear-out apparatus 10 is pushed into upper chute 41 which leads to lower chute 42 and eventually to coin return 50. Alternatively, material 45 lodged within coin processing apparatus 20 is released into lower chute 42 and, thereafter, into coin return 50 which also receives coins routed by coin diverter 25.

Figure 2:
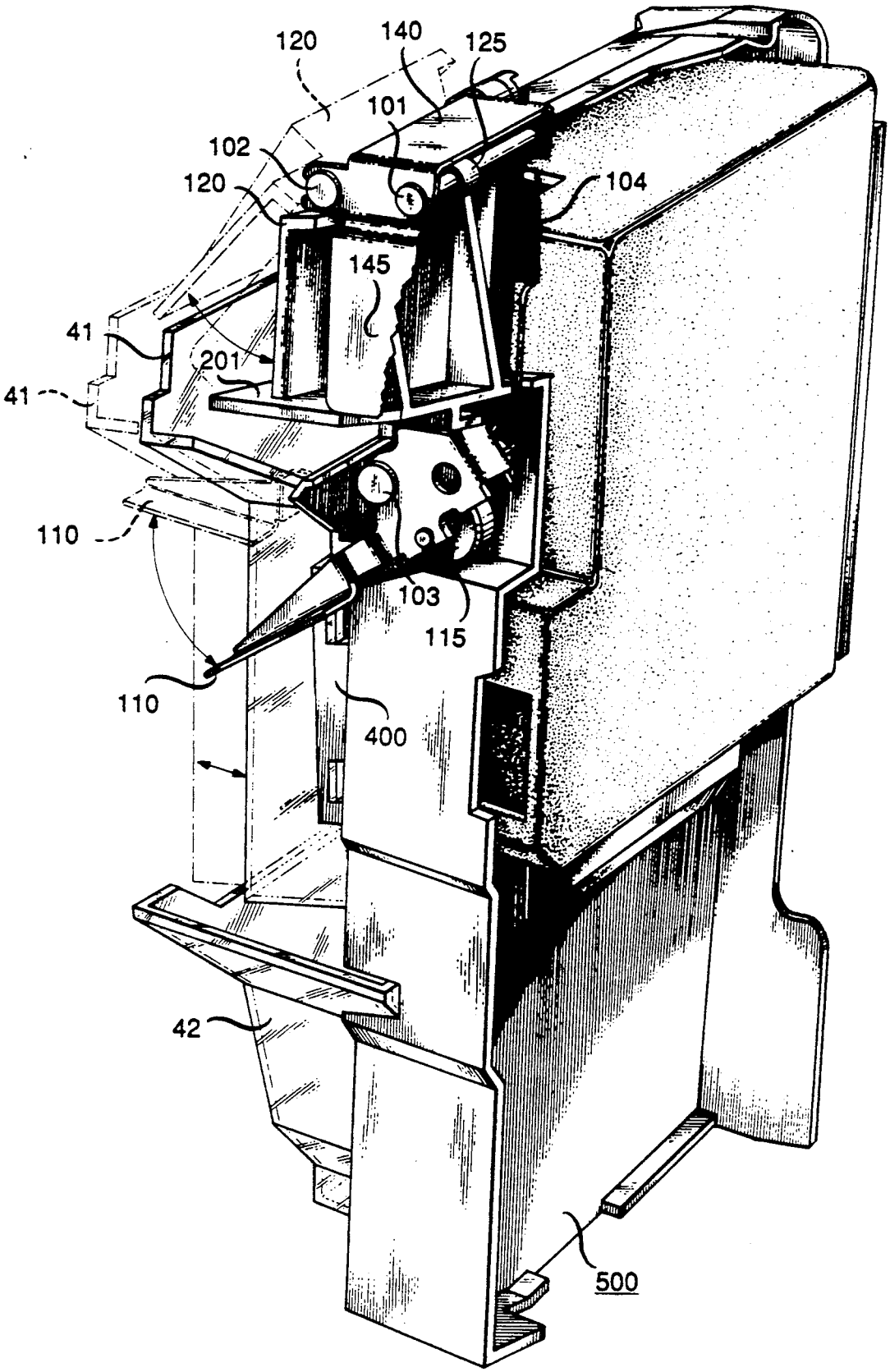
FIG. 2 discloses a perspective view of the clear-out apparatus for a coin chute showing the cooperative interconnection of parts in accordance with the invention.

FIG. 2 is a perspective view of the various parts that are cooperatively interconnected in a clear-out apparatus that not only allows material to fall into upper chute 41, but also pushes material into it. Coins inserted into coin entrance 105 pass between an outer sidewall 120 and an inner sidewall 130 (see FIG. 3). These sidewalls pivot around pin 102 when actuator 110 is operated. The positions of various parts are shown, after operation of the actuator 110, by broken lines. Actuator 110 is mounted on housing 500 using a pin 103, so that it can rotate. When it is rotated in a clockwise direction, helical spring 104 is pulled downward to similarly rotate sidewall 120 in a clockwise direction. This is shown more clearly in FIG. 3. Spring 104 applies a downward force to arm 125, which is integral with sidewall 120, causing it to pivot around pin 102. As sidewall 120 opens, material trapped in the cavity 100 between the sidewalls 120, 130 is allowed to gravitate along inclined platform 201 into the upper chute 41. Platform 201 is tilted toward upper chute 41 and toward the coin processing apparatus (not shown in FIG. 3). However, this is frequently insufficient to remove material that is attached to platform 201. Fortunately, the present invention remedies this problem. Inner sidewall 130 commences rotating after the outer sidewall 120 has rotated through one-half of its motion (approximately twenty-three degrees). At this time, in particular, top surface 127 of sidewall 120 makes contact with shoulder 135 of sidewall 130 causing it to rotate in the same direction and to push material, trapped within cavity 100, into upper chute 41.

Figure 3:
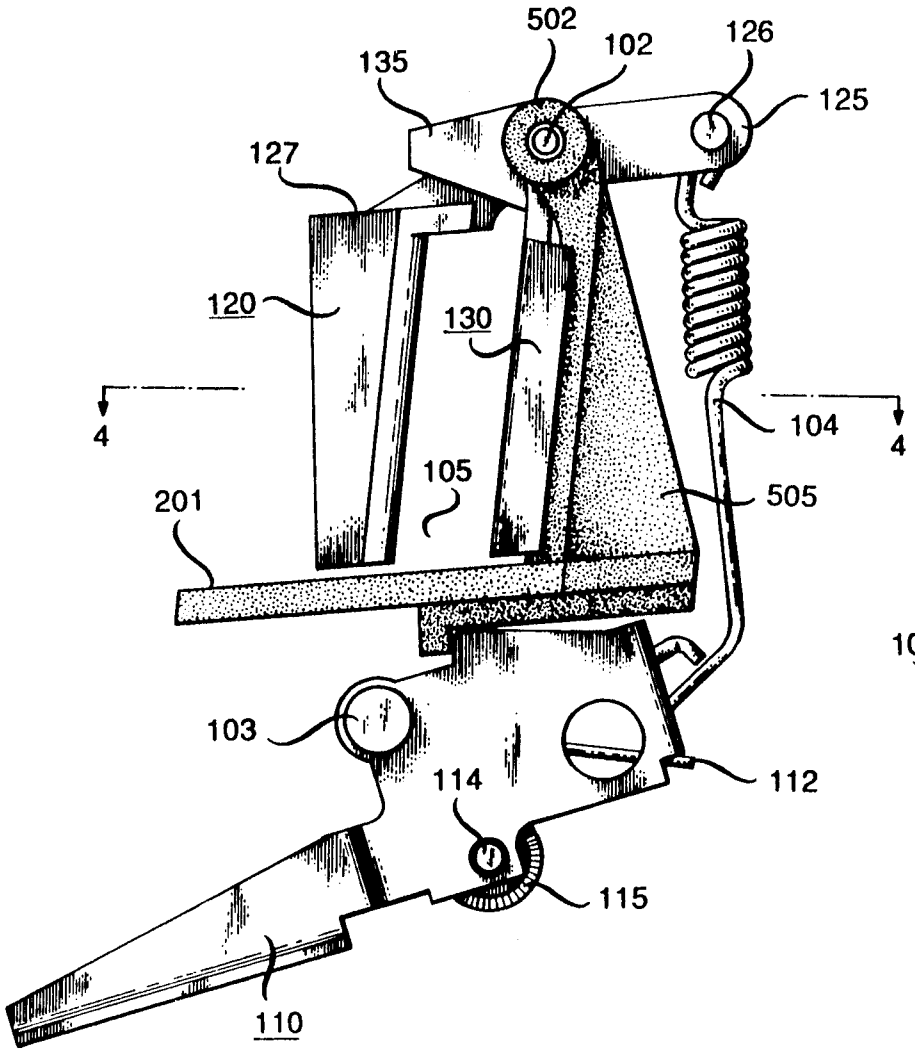
FIG. 3 provides a detailed front view of the clear-out apparatus showing the coin entrance.

Housing 500 (not shown in FIG. 3) is molded from a thermoplastic material such as ABS (Acrylonitrile-Butadiene-Styrene) and includes inclined platform 201 and wall 505 which support those parts used in constructing the clear-out apparatus. The parts of the clear-out apparatus shown in FIG. 3 are made from metal because relatively high strength is required. Nevertheless, despite their strength, spring 104 is used to limit the amount of force which can be applied to any part in the linkage in order to prevent damage when excessive force is applied to eject material trapped within cavity 100. Spring 104 is helical in shape and begins elongating after a predetermined amount of force is applied. Energy is stored in the spring which restores it to its original shape when the force is removed. Most material will be removed from the clear-out apparatus before the spring begins to elongate; nevertheless, it is better to fail to remove material than to damage the coin ejector—either situation requires a maintenance visit, but one is less expensive than the other.

Referring once again to FIG. 2, the operation of entrance shield 140 is now discussed. The front cover 145 of entrance shield 140 is only partially shown so that the supporting structure behind it can be seen. The supporting structure includes support member 502 (see FIG. 3) which holds pivot pin 102. When spring 104 is pulled downward, link pin 101 is also pulled downward and entrance shield 140 rotates clockwise around pivot pin 102 (similar to the sidewalls), so the front cover 145 will be positioned in front of the coin entrance and thereby stop any further material from being stuffed into the coin chute. Indeed, when material (folded matchbook cover or wadded paper) already within the cavity between the sidewalls begins to expand, it pushes against the outer sidewall 120 and causes it to rotate together with entrance shield 140 which is linked thereto. The outer sidewall rotates due to the pressure of the expanding material until it engages the inner sidewall and then stops. At this time, the front cover 145 of entrance shield 140 completely covers the coin entrance. The top horizontal surface of the entrance shield provides a rigid member for separating a pair of vertical surfaces which include holes for supporting link pin 101 at opposite ends thereof. Spring 104 attaches to one end of link pin 101 which also passes through a hole in arm 125 of the outer sidewall 120. Accordingly, as actuator 110 is rotated clockwise around pin 103, spring 104 pulls link pin 101 downward which, in turn, causes outer sidewall 120 and entrance shield 140 to rotate together around pivot pin 102. After approximately twenty-three degrees of rotation, the outer wall engages the inner sidewall and causes it to rotate around pivot pin 102 and push material, trapped between the sidewalls, into the upper chute 41. Actuator 110 includes rolling member 115 which pushes against door 400 when it is operated to cause the door to move away from housing 500 and release material and coins trapped within the coin processing apparatus to fall into lower chute 42. More will be said about door 400, housing 500, and the cooperation between them in connection with FIG. 5.

FIG. 3 provides a front view of the coin entrance and the various parts that cooperate to make it particularly effective. Outer sidewall 120 and arm 125 comprise a single piece part that rotates around pivot pin 102 when spring 104 is pulled downward. This occurs when actuator 110 rotates around mounting pin 130. Additionally, inner sidewall 130 also rotates around pivot pin 102 which connects the rotating sidewalls to support member 502 of the housing. The region between the sidewalls 120, 130 expands as the outer sidewall 120 rotates, and material trapped between the sidewalls will gravitate, from right to left, along inclined platform 201 into upper return chute 41 (see FIG. 2). Material that does not gravitate in this manner is pushed by inner sidewall 130 after the upper surface 127 of the outer sidewall engages shoulder 135 of the inner sidewall. Roller 115 is attached to actuator 110 by means of a rivet which fits into opening 114. When the actuator is released, partially shown spring 112 causes counterclockwise rotation which returns the actuator to its rest position. Support wall 505 provides a stop for the inner sidewall and fixes the position of coin entrance 105. A cross-section of the sidewalls is shown in FIG. 4 to reveal the structure of cavity 100 which is most important to the effective operation of the invention.

Figure 4:
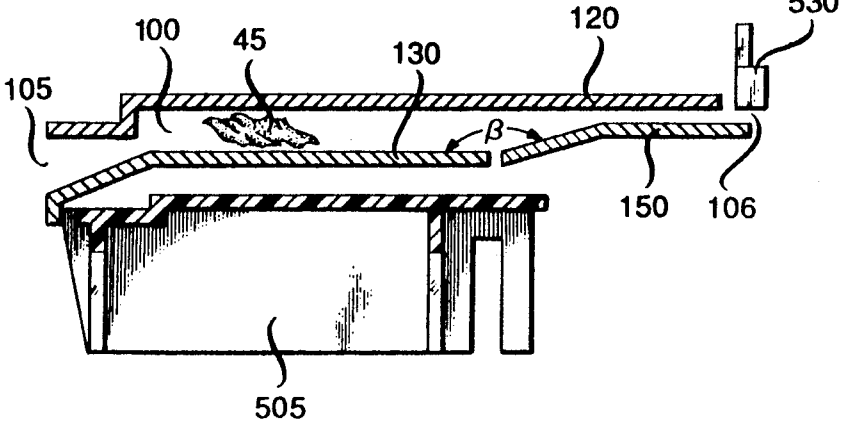
FIG. 4 is a cross-section view of FIG. 3 showing the interior of the clear-out apparatus.

FIG. 4 illustratively discloses the structure of cavity 100 which is illustratively shown as a generally rectangular region including movable inner sidewall 130, movable outer sidewall 120, coin entrance 105 at one end, and coin exit 106 at the other end. The separation between the inner and outer sidewalls is greater than the normal width of the coin path in order to assist deflector plate 150 trap material within the cavity. Coin entrance 105 resides between the inner and outer sidewalls and is sized to admit the largest acceptable coin of the set of coins that can be processed by the coin chute. Illustrative material 45, such as cotton, paper, matchbook covers, etc., can also be forced into the coin entrance but will be impeded by deflector plate 150 before reaching coin exit 106 which leads into the coin processing apparatus. The plate provides an obstruction in the coin path leading from the coin entrance to retard the progression of anything inserted therein. Accordingly, deflector plate 150 causes material 45 to collect and press against outer wall 120. Movement of the outer wall then causes the entrance shield, discussed above, to cover coin entrance 105 and preclude additional material from being forced into the cavity 100. Even when material 45 stuffed into the cavity does not reach the deflector plate 150, it frequently expands against the sidewalls and closes the coin entrance. Deflector plate 150 is positioned in the coin path at an obtuse angle $\beta$ (illustratively 135°) so that coins, forcefully inserted, will be slowed, not stopped, and directed toward coin exit 106 which also serves as the entrance to the coin processing apparatus. Deflector plate 150 is made from metal and is attached to housing 500. It is shown in greater detail in FIG. 6 and is positioned at the entrance to the coin processing apparatus. A sizing member 530 cooperates with the deflector plate 150 and housing 500 to form the carefully dimensioned coin exit 106 which accurately precludes coins that are either too thick or warped from advancing. Sizing member 530 remains at a fixed distance from housing 500 when actuator 110 (see FIG. 3) is operated so that attempts to change the dimensions of coin exit 106 will be frustrated. Accordingly, coin exit 106 performs the coin measuring function with great accuracy. To preserve this accuracy, sizing member 530 is shielded from acts of vandalism such as the insertion of harmful objects into the coin entrance. The cooperation between movable sidewalls and an enlarged region (cavity 100) of the coin path brings the benefits of durability, reliability, and accuracy to a coin chute.

Figure 5:
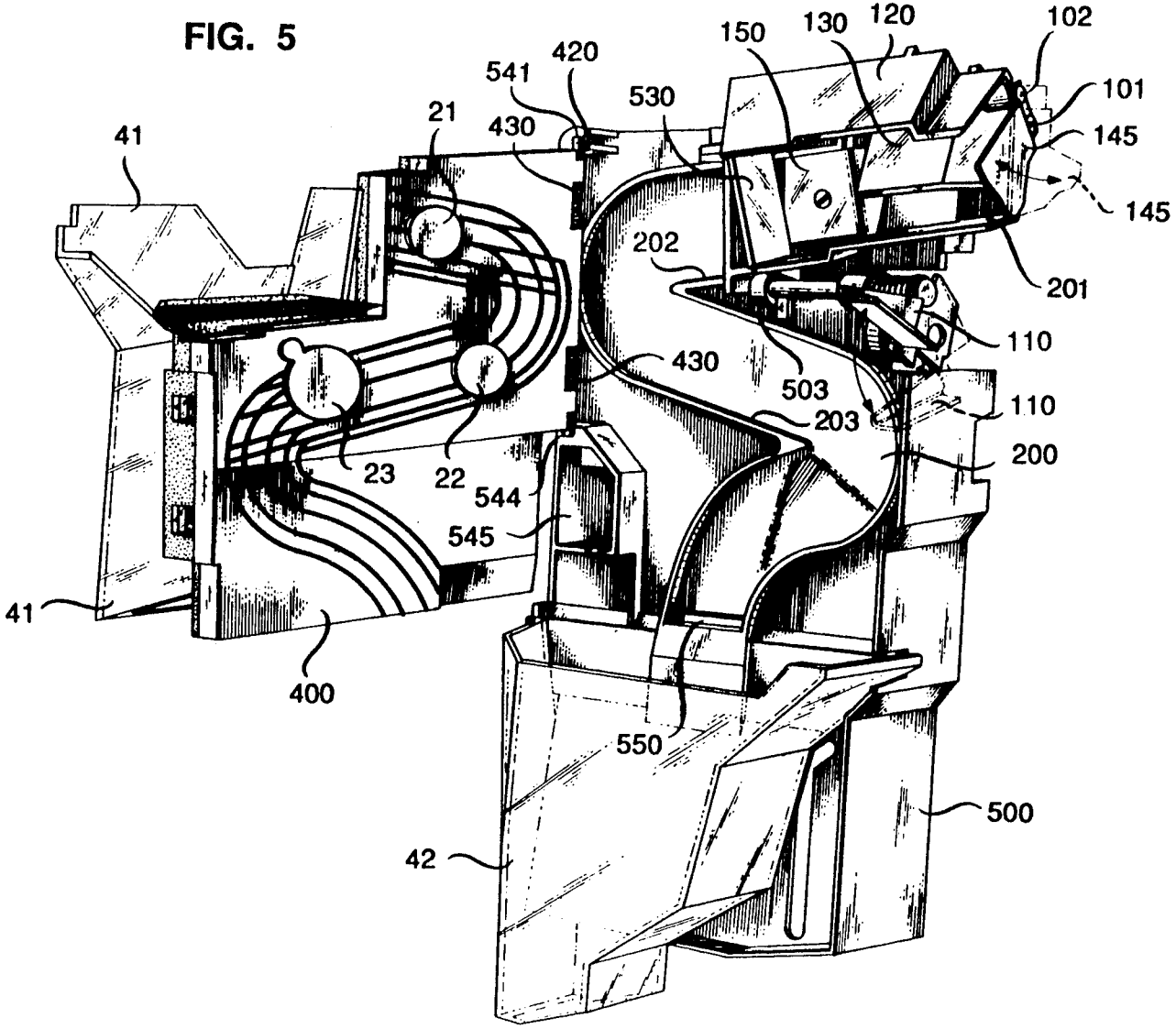
FIG. 5 discloses a perspective view of a coin processing apparatus.

FIG. 5 shows a perspective view of the coin processing apparatus which includes housing 500 and a spring loaded door 400. Door 400 is joined to housing 500 by pin 420 which is captured by retaining slots 541, 544. Spring 430 is also captured by pin 420 and fits through slots (not shown) in the housing to hold the door closed. When the door is closed, a passageway (coin track 200) is defined by coin rails 202, 203 which are slightly wider than the thickest acceptable coin. Coins gravitate along coin track 200 where their presence and their qualities (composition and size) are measured by sensors 21, 22, 23. All coins enter slot 550 where they are either diverted into a collection box 60 or routed into lower chute 42 which leads to coin return 50 (see FIG. 1). Sensors 21–23 are embedded within door 400 and comprise individual coils which have mating counterparts embedded within coin track 200. Each coil and its mating counterpart are connected via wires (not shown) that pass through opening 545 in housing 500. Coins enter the housing on surface 201 and gravitate toward coin rail 202 after being deflected as described above. Sizing member 530 is attached to housing 500, and cooperates with metal deflector plate 150 and the housing to provide a carefully dimensioned opening for admitting coins of predetermined maximum dimensions into the coin processing apparatus. If, however, a coin becomes stuck in coin track 200, it can be released into lower chute 42 by opening door 400 slightly. This is accomplished by rotating actuator 110 which includes a roller that pushes against door 400 and moves it away from housing 500. By thus increasing the distance between the door and the housing, bent coins and the like are released to either continue along coin track 200, or to fall into lower chute 42. It will be appreciated that operation of the actuator simultaneously releases material stuck within the coin track, and "sweeps out" material that is trapped within the cavity of the clear-out apparatus before it even enters the coin processing apparatus.

Deflector plate 150 is positioned directly in the coin path to slow down the velocity of incoming coins so that all will enter the coin processing apparatus at nearly the same velocity. Its metal structure renders it impervious to the effects of frequent coin interactions and sharp objects inserted into the coin entrance by those seeking to damage the coin chute. The deflector plate also functions to deflect unwanted material toward the outer sidewall causing it to rotate open and move the front cover 145 of the entrance shield into a position that precludes additional material from being inserted.

Figure 6:
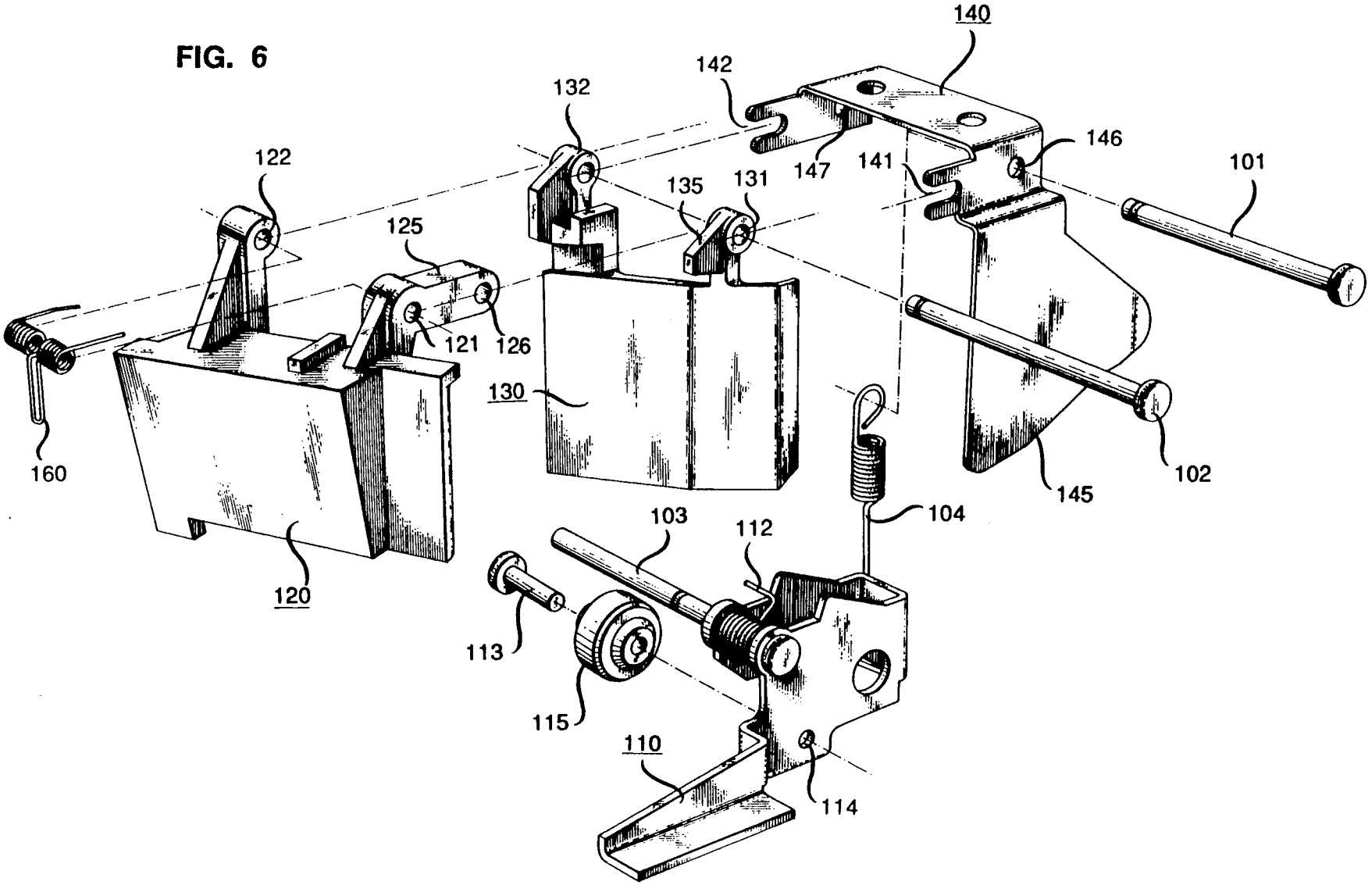
FIG. 6 discloses an exploded perspective view of various parts used in the clear-out apparatus in accordance with the invention.

An exploded, perspective view of the various parts used in the clear-out apparatus are shown in FIG. 6 showing their relative interconnection arrangement. Pivot pin 102 joins together three moving parts: outer sidewall 120, inner sidewall 130, and entrance shield 140. Pivot pin 102 passes through openings 121–122, 131–132, and 141–142 respectively in these moving parts. Spring 160 is also captured by pivot pin 102. It presses against both the underside of entrance shield 140 and inner sidewall 130 to impart a force on the inner sidewall that pushes it against support wall 505 (see FIG. 5).

Link pin 101 links outer sidewall 120 to entrance shield 140 so that they will rotate together. Link pin 101 passes through openings 126, and 146–147 respectively in these parts. Accordingly, when the outer sidewall moves, either because material trapped between the sidewalls 120, 130 is expanding or because actuator 110 is being operated, the front cover 145 of entrance shield 140 will be positioned in front of the coin entrance and thereby stop any further material from being stuffed into the coin chute. Arm 125 of the outer sidewall 120 operates to convert the downward force applied to link pin 101, by spring 104, into clockwise rotational motion around pivot pin 102. After the outer sidewall has rotated about twenty-three degrees, its top surface makes contact with shoulder 135 of inner sidewall 130 causing it to also rotate around pivot pin 102.

Spring 104 links actuator 110 to the rotating sidewalls to transfer only a limited amount of force to link pin 101. If the material trapped between the sidewalls 120, 130 is so tightly attached to platform 201 (see FIG. 5) that the sidewalls will not move, then the spring will elongate and thereby prevent excessive force from damaging any of these linked parts (linkage). Similarly, if a rigid object is inserted into the coin entrance, the entrance shield will not be able to rotate to cover the entrance and spring 104 will limit the amount of force that can be applied to the linkage. Spring 104 is attached to actuator 110 by means of a rivet 111. Also attached to the actuator with a rivet is rolling member 115 which pushes against door 400 (see FIG. 5), when the actuator is operated, to increase the separation between the door and housing 500 thereby releasing any material or stuck coins between them. The actuator is itself attached to the housing by means of mounting pin 103. Mounting pin 103 captures spring 112 which imparts a small, counterclockwise force on the actuator so roller 115 is not touching door 400 during normal operation.

While a particular embodiment of the invention has been shown and described, it is understood that various modifications are possible within the spirit and scope of the invention. Such modifications include, but are not limited to: variously shaped cavities that function to trap unwanted material therein, sidewalls and actuators whose movement is translational rather than rotational, the use of springs in the linkage that absorb energy in ways other than elongation, and the use of the invention in coin chutes that are neither electronic nor associated with telephone equipment.

We claim:

1. Coin-operated equipment including a clear-out apparatus, ejector means, and a return chute; the clear-out apparatus including a cavity which comprises a coin entrance at one end thereof, a coin exit at the other end, and a coin path therebetween, said apparatus

CHARACTERIZED BY:

deflection means positioned within the cavity for interrupting the forward progress of material inserted into the coin entrance, and trapping said material within the cavity;

an outer sidewall, positioned within the cavity on one side of the coin path, responsive to the operation of the ejector means for releasing material, trapped within the cavity, into the return chute;

an inner sidewall, positioned within the cavity on the other side of the coin path, responsive to the operation of the ejector means for pushing material, trapped within the cavity, into the return chute, said ejector means including an actuator that is operatively connected to said sidewalls by a mechanical spring that is adapted to commence storing energy after a predetermined force is applied by the actuator.

2. The coin-operated equipment of claim 1 wherein the mechanical spring comprises a helical spring that stores energy through elongation.

3. The coin-operated equipment of claim 1 further including means operatively connected to the outer sidewall for covering the coin entrance, the outer sidewall being movably responsive to material within the cavity pressing against it; whereby material that expands within the cavity causes the coin entrance to be closed.

4. The coin-operated equipment of claim 1 wherein the coin processing apparatus includes a housing and a door which form the walls of a passageway through which coins travel under the influence of gravity, the pasageway including a rail of predetermined width over which coins roll, said ejector means including means for increasing the separation between the housing and the door when the ejector means is operated so that material lodged within the passageway will fall into the return chute; whereby coins, whose thickness exceeds the predetermined width of the rail, will be released into the return chute when the ejector means is operated.

5. The coin-operated equipment of claim 4 wherein the door is rotatably mounted on the housing on an axis that includes a spring member which applies a force to the door and to the housing that tends to decrease the separation therebetween.

6. The coin-operated equipment of claim 5 wherein the means for increasing the separation between the door and the housing comprises the actuator, the actuator being rotatably mounted on the housing and includes a member that presses against the door when the actuator is operated; whereby the same actuator used to release material from the clear-out apparatus cooperates to remove material from the coin processing apparatus.

7. In a coin-operated machine, a coin chute comprising a coin entrance, a first section adjacent to the coin entrance for trapping unwanted material therein, a second section adjacent to the first section for examining coins for authenticity and denomination, and a return chute for returning certain coins and unwanted material; a guideway extends through the first and second sections for guiding coins between the coin entrance and the return chute, within the first section the guideway is substantially wider than in the second section and includes movable inner and outer sidewalls on opposite sides thereof, said sidewalls being connected, via mechanical linkage, to an actuator for pushing trapped material into the return chute; whereby unwanted material is readily trapped in the enlarged portion of the guideway and positively ejected by the pair of moving sidewalls.

8. The coin-operated machine of claim 7 wherein the outer sidewall includes means for engaging the inner sidewall after a predetermined amount of movement to thereby cause the inner sidewall to move; whereby the inner and outer sidewalls cooperate in removing material from the coin chute.

9. The coin-operated machine of claim 7 wherein the mechanical linkage includes a spring operatively connected between the actuator and the inner sidewall; whereby the force that can be applied to the mechanical linkage is limited by characteristics of the spring.

10. The coin-operated machine of claim 7 wherein the spring is helical and stores energy through elongation.

* * * * *